US006261021B1

(12) United States Patent
Pfanner et al.

(10) Patent No.: US 6,261,021 B1
(45) Date of Patent: Jul. 17, 2001

(54) BINDER INSERT HAVING A CLIP

(75) Inventors: Stephan Peter James Pfanner; Michael Albertini, both of Chicago; Sumir Kapur, Oak Park, all of IL (US); Paul Rossetto, Oak Creek, WI (US); Christopher Conley, Chicago, IL (US); Cira Conley, Chicago, IL (US); Scott Ternovits, Chicago, IL (US); Denise Steiner, Chicago, IL (US); Scott Harold Wilson, Evanston, IL (US); Fred Edward Cecala, Mount Prospect, IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/441,192

(22) Filed: Nov. 16, 1999

(51) Int. Cl.[7] ..... B42F 13/00

(52) U.S. Cl. ..... 402/79; 402/4; 402/802; 281/45; 281/15.1; 281/51; 281/39

(58) Field of Search ..... 281/42, 38, 45, 281/33, 15.1, 44, 51, 39; 402/79, 4, 802

(56) References Cited

U.S. PATENT DOCUMENTS

| | | | | |
|---|---|---|---|---|
| 782,773 | | 2/1905 | Bohn . | |
| 861,146 | | 7/1907 | Smead . | |
| 868,835 | | 10/1907 | Bexell . | |
| 1,359,959 | | 11/1920 | Brown . | |
| 2,176,567 | | 10/1939 | Ellis | 281/44 |
| 2,223,560 | | 12/1940 | Friedlaender | 281/31 |
| 2,453,459 | * | 11/1948 | Roberts | 402/802 |
| 2,716,985 | | 9/1955 | Wolf | 129/1 |
| 3,126,891 | | 3/1964 | Caputi | 129/1 |
| 4,402,530 | | 9/1983 | Daguerre | 281/45 |
| 4,614,450 | | 9/1986 | Neiman | 402/79 |
| 4,743,050 | | 5/1988 | Small | 281/45 |
| 4,984,924 | | 1/1991 | Erlich | 402/4 |
| 5,219,239 | | 6/1993 | Bianco | 402/79 |
| 5,240,340 | | 8/1993 | Lynch et al. | 402/79 |
| 5,285,952 | | 2/1994 | Ho | 229/1.5 R |
| 5,290,118 | | 3/1994 | Ozeki | 402/79 |
| 5,413,382 | | 5/1995 | Cornell et al. | 281/45 |
| 5,590,910 | * | 1/1997 | Meth | 281/45 |
| 5,639,016 | | 6/1997 | Ho | 229/67.4 |
| 5,693,791 | | 12/1997 | Truett | 540/222 |
| 5,765,873 | | 6/1998 | Chen | 281/45 |
| 5,915,873 | | 6/1999 | Karlis | 402/79 |
| 5,971,985 | | 10/1999 | Carchidi et al. | 606/61 |
| 5,971,987 | | 10/1999 | Huxel et al. | 606/73 |

FOREIGN PATENT DOCUMENTS 2 448 443 9/1980 (FR) .

OTHER PUBLICATIONS

U.S. Design Patent No. 29/113,883, filed Nov. 16, 1999, entitled "Folder with Spring Clips".
U.S. Design Patent No. 29/113,884, filed Nov. 16, 1999, entitled "Writing Tablet Having a Movable Clip".

* cited by examiner

*Primary Examiner*—Willmon Fridie, Jr.
(74) *Attorney, Agent, or Firm*—Pennie & Edmonds LLP

(57) ABSTRACT

A binder insert with a folder portion and a clip. The folder portion defines at least one ring aperture configured and dimensioned to receive and mount to rings of a binder. The folder portion also has a first sheet defining a clip-mounting aperture and a second sheet facing the first sheet. The clip includes first and second clip portions resiliently biased toward each other. The clip is mounted to the first sheet through the clip-mounting aperture, and the first and second clip portions are disposed in a clamping position on the exterior of the first and second sheets and compressively engaged against the sheets to bias them against each other.

13 Claims, 10 Drawing Sheets

BINDER INSERT HAVING A CLIP

BACKGROUND OF THE INVENTION

Known folders used for the orderly arrangement of paper include binders, ring binders, and folders using tongue lock systems, have retaining means which necessitate at least one perforation in each sheet of paper or card which is to be placed therein. However, it is often desirable to maintain the integrity of a sheet of paper or other such article and avoid perforation. Accordingly, a binder insert used in combination with such a folder can avoid perforating a sheet of paper or other article while still being able to maintain the use of such a folder to organize papers. Furthermore, often times it is desirable to organize articles other than sheets of paper in a ring binder. For example, attaching a computer disk, compact disc or audiocassette tape to a ring binder typically requires a separate attachment means. For optimal convenience and accessibility, binder inserts of this type should securely hold the sheet and/or other articles and be readily positionable in a binder while securely maintaining the article with the binder insert.

It is also desirable to be able to remove subsets of information out of a binder easily, especially frequently accessed information. In this regard, it is also desirable to maintain the integrity of a sheet such as a paper document during its filing, retrieval and transport. For example, certain sheets such as photographs may require special handling so as to not only prevent perforation but also to prevent damage such as markings or tearing of the sheet during transportation. Accordingly a binder insert providing sheet protection as well as an appropriate securing means that prevents tearing the document is desired.

SUMMARY OF INVENTION

A binder insert with a folder portion and a clip. The folder portion preferably defines at least one ring aperture configured and dimensioned to receive and mount to rings of a binder. The folder portion also preferably has a first sheet defining a clip-mounting aperture and a second sheet facing the first sheet. The clip includes first and second clip portions resiliently biased toward each other. The clip is mounted to the first sheet through the clip-mounting aperture, and the first and second clip portions are disposed in a clamping position on the exterior of the first and second sheets and compressively engaged against the sheets to bias them against each other.

This permits papers or other objects to be held to the rings of a binder, such as a ring binder, without puncturing or deforming the papers. The papers can be easily inserted or extracted, and the entire insert can be removed from the binder for use as a folder or a writing tablet. One of the embodiments has a writing tablet, with a protective sheet also movably attached thereto with the clip.

DETAILED DESCRIPTION OF THE PREFERRED EMBODIMENTS

Figure 1:
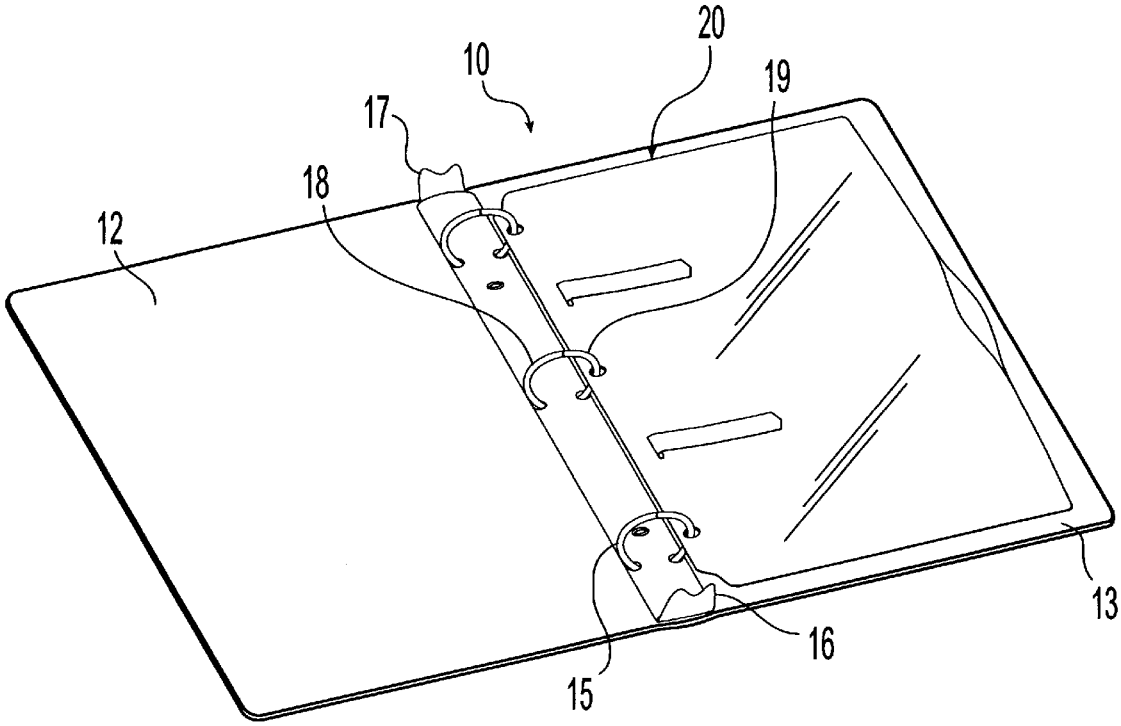
FIG. 1 is a perspective view of a first embodiment of the binder insert of the present invention in combination with a conventional ring binder type notebook.
Figure 2:
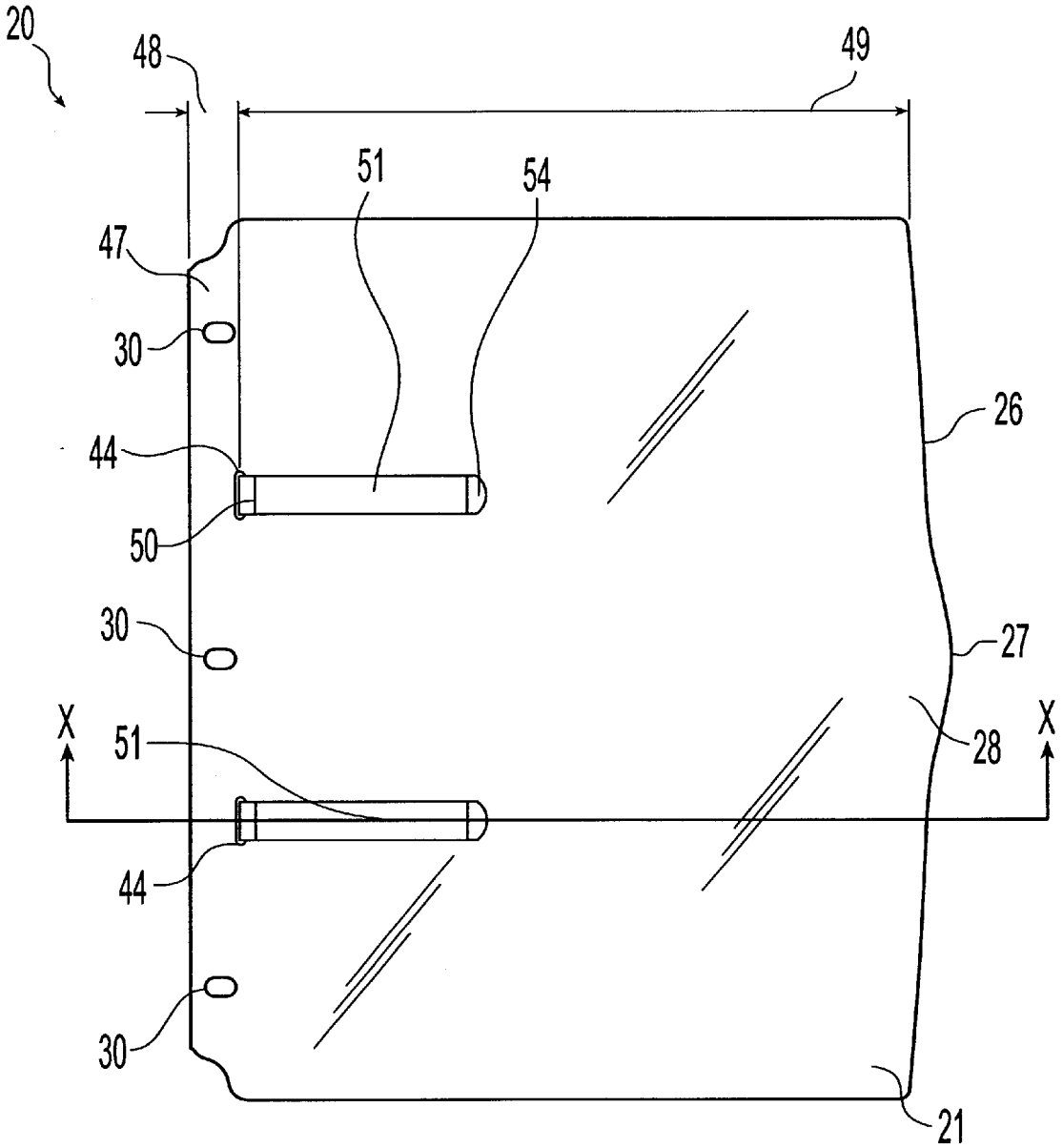
FIG. 2 is a top view of the first embodiment of the binder insert.
Figure 3:
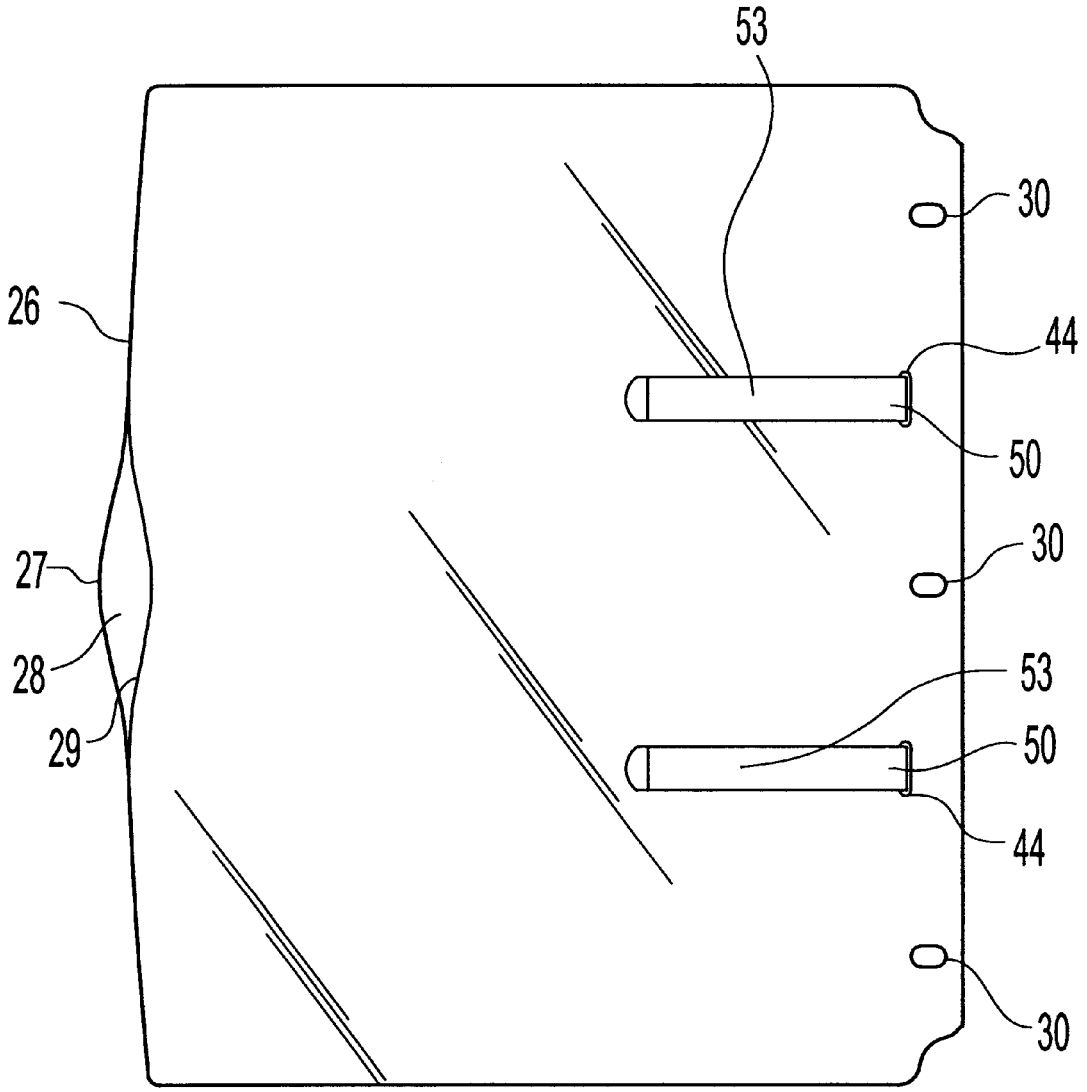
FIG. 3 is a bottom view of the binder insert of FIG. 2.
Figure 4:
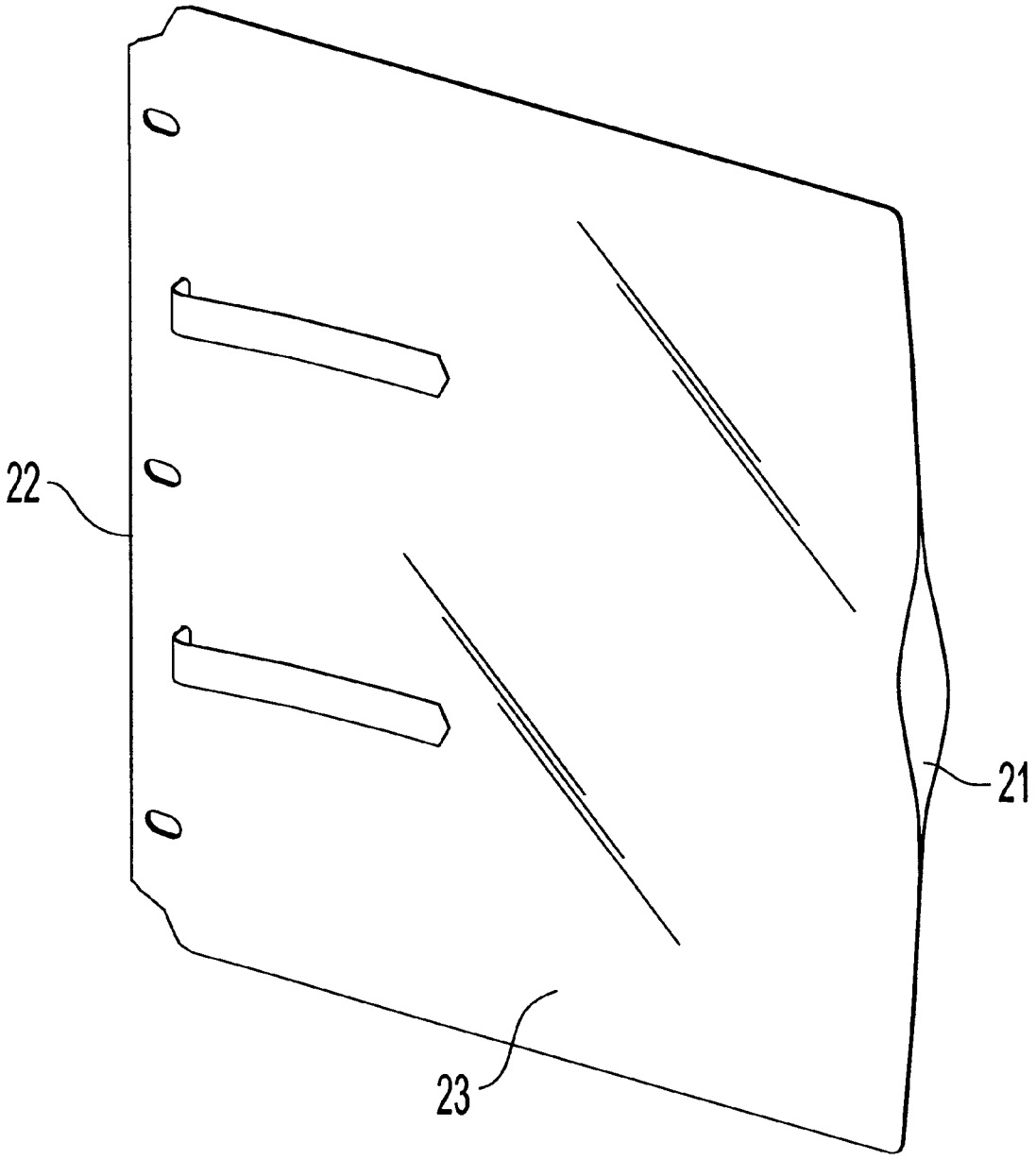
FIG. 4 is a perspective view if the binder insert of FIG. 2.
Figure 5:
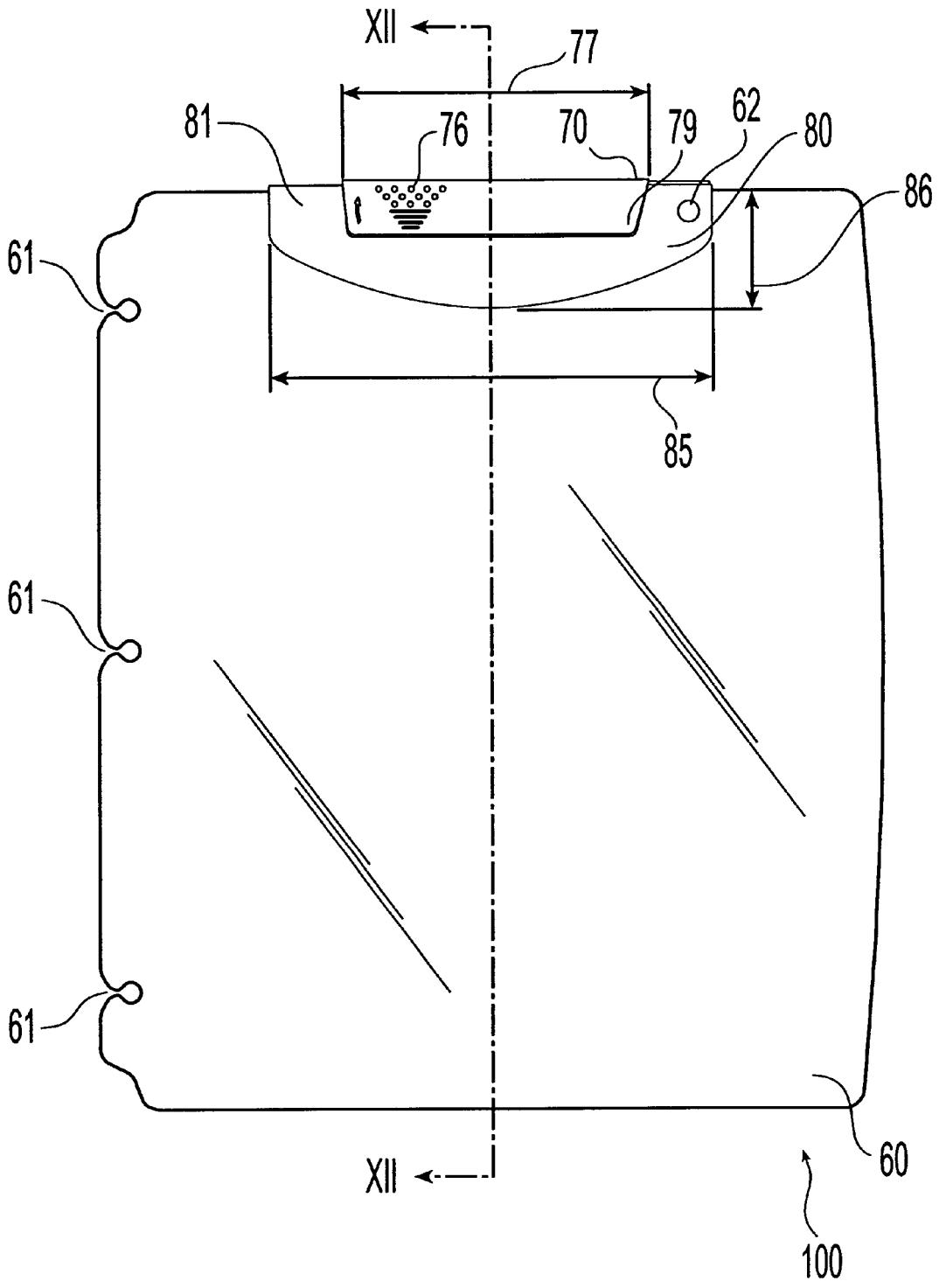
FIG. 5 is a top view of a second embodiment of the binder insert of the present invention.
Figure 7:
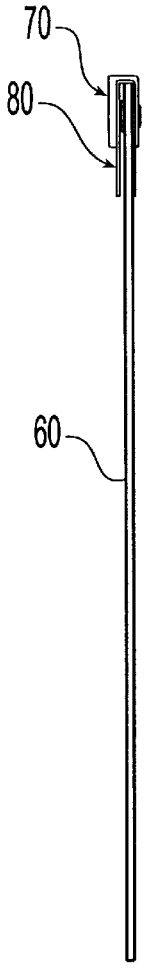
FIG. 7 is a side view of the binder insert of FIG. 5.
Figure 6:
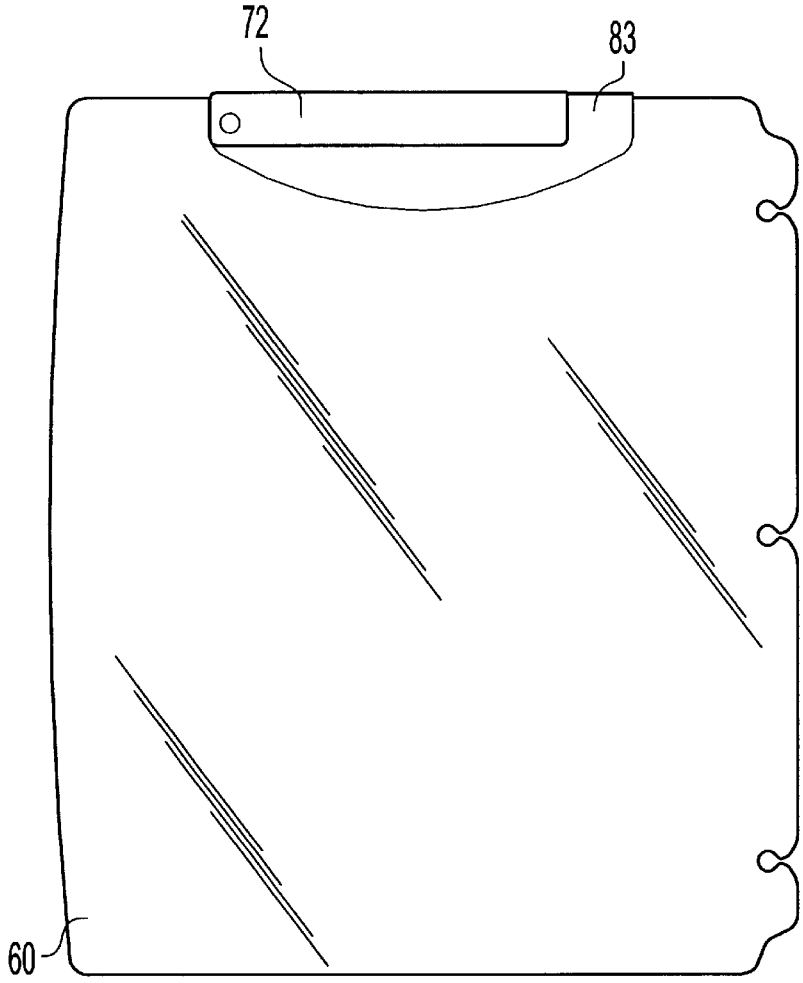
FIG. 6 is a bottom view of the binder insert of FIG. 5.
Figure 9:
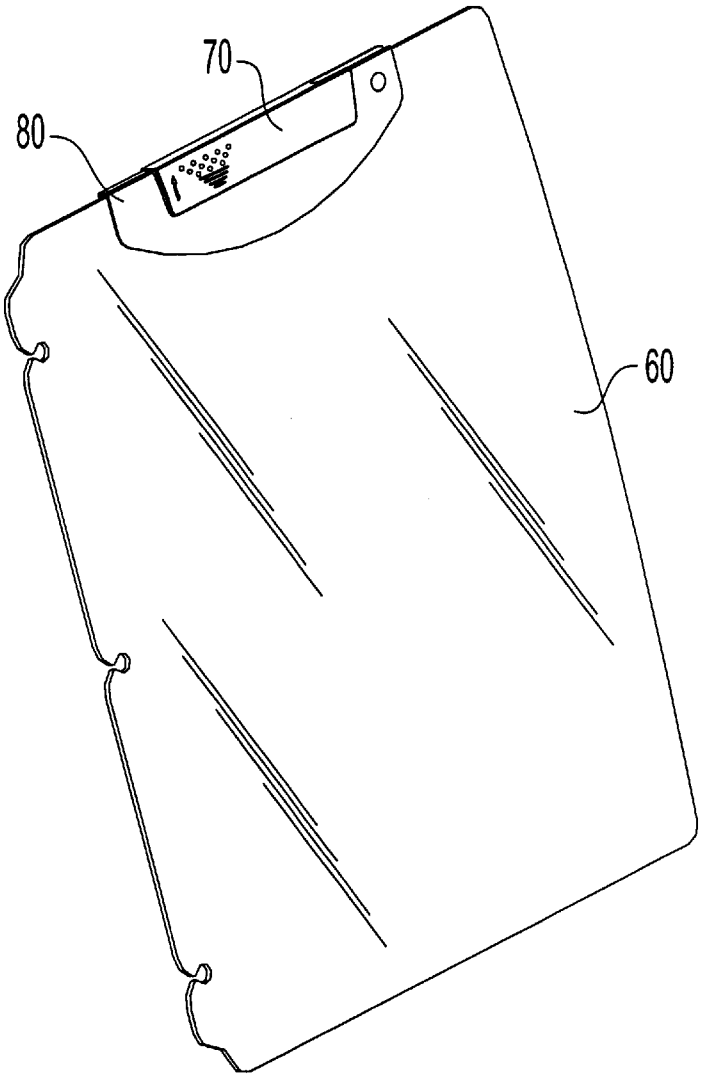
FIG. 9 is a perspective view of the binder insert of FIG. 5.

The present invention is directed to a sheet bolder, such as a binder insert to be used in combination with a ringed notebook or binder. FIG. 1 shows an exemplary combination in accordance with the present invention with a binder insert 20, and an arrangement for supporting the insert within a ring binder 10. The preferred ring binder 10 is a conventional loose-leaf ring binder or notebook having two rigid, rectangular panels forming front and back covers 12, 13 that are each hingedly connected along one edge to an elongated spine 14. A binding mechanism has a plurality of similar metal rings 15 that can be opened and closed and are preferably evenly spaced along spine 14 or one of the front and back covers 12, 13. Rings 15 can preferably be opened and closed by depressing or raising two tabs 16, 17 at opposite ends of spine 14. Rings 15 are typically spring-loaded so that the two legs 18, 19 of each ring snap shut on the application of a small amount of pressure. Ring binder 10 is configured to contain a plurality of rectangular paper pages (not shown) that fit between front and back covers 12, 13 and have holes punched therein that receive the rings. Thus, the pages can be turned individually when rings 15 are closed, and can be removed by opening the rings. The most common ringed notebook size in the United States is designed for punched paper sheets that are 8½×11 inches in dimension. However differently dimensioned ringed notebook sizes and shapes are also employed.

Referring to a first embodiment of the binder insert of the present invention, which is shown in FIGS. 1 through 4, a binder insert 20 has a front sheet portion 21, a back sheet portion 23, and a hinge portion 22 for hinging together adjacent edge sections of front and back sheet portions 21, 23. Front and back sheet portions 21, 23 are preferably flexible and of sufficient width and length to completely cover an 8½×11 inch sheet of paper, although the dimensions can be easily altered to accommodate different size articles. On the opposite edge of hinge portion 22 an opening 26 is defined for inserting sheets of paper and/or other articles between front and back sheet portions 21, 23. Opening 26 preferably has a tab 27 along the edge of binder insert 20. Tab 27 has an extension 28 which preferably extends from the edge of front sheet portion 21, and back sheet portion 23 has a corresponding indentation 29 in the edge to provide a simple way to open binder insert 20 and allow for easy insertion of sheets and/or other articles. Preferably front and back sheet portions 21, 23 are part of a unitary sheet and preferably hinge portion 22 is substantially formed by a fold in the continuous sheet so that a common edge interconnects front and back sheet portions 21, 23 to form a living hinge, although other hinges are suitable.

An alternative embodiment is hingeless and its front and back sheet portions 21, 23 are preferably constructed separately and can be fixed to one another.

Front and back sheet portions 21, 23 are preferably made of a polymeric material such as polypropylene or polyethylene, however, other material suitable for binder inserts such as paperboard may be used. Preferably front and back sheet portions are translucent to allow the contents held therein to be easily viewed and readily located and or to avoid the necessity of removing the contents from binder insert 20 in order to gather information therefrom.

A plurality of ring apertures 30 are spaced horizontally inward from the edge adjacent the hinge portion 22 for mounting binder insert 20 to ring binder 10. The preferred ring apertures 30 are circular, although elongated or other shapes can alternatively be used.

Clamp openings which are preferably a pair of slots 44 extend vertically through front and back sheet portions 21, 23 and are located towards the edge adjacent the hinge portion 22, spaced slightly further horizontally inward than apertures 30.

Figure 10:
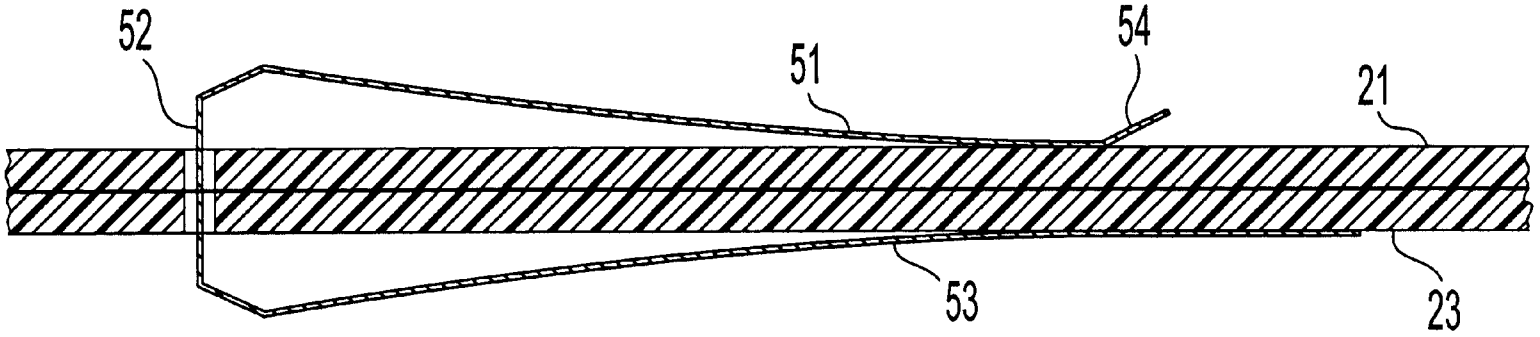
FIG. 10 is a horizontal sectional view of the binder insert of FIG. 2 taken along the line A—A of FIG. 2.
Figure 11:
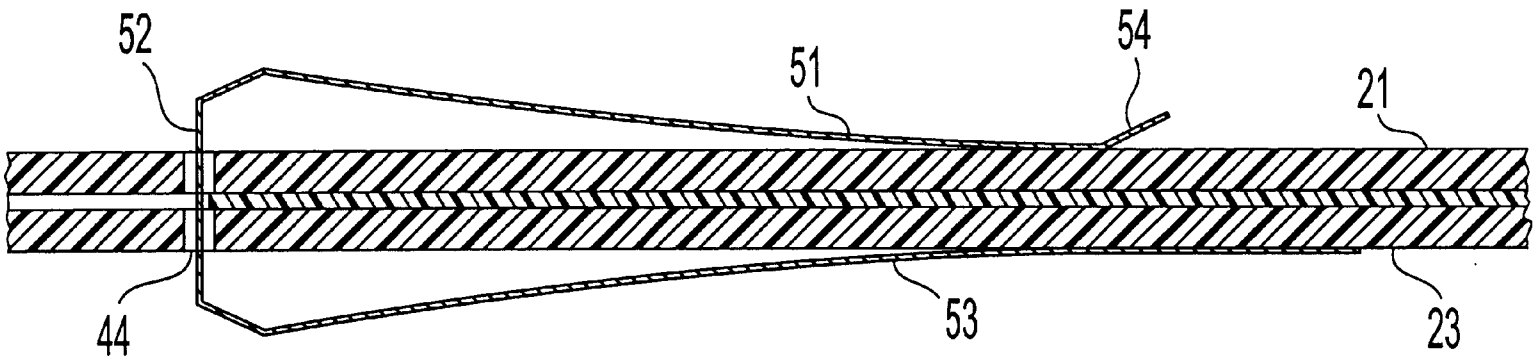
FIG. 11 is a horizontal sectional view of the binder insert of FIG. 2 with a sheet therein.

Clamps 50 extend through each slot 44 and straddle the outer surfaces of front and back sheet portions 21, 23. As can be seen in FIGS. 10 and 11, each clamp 50 is preferably C-shaped and has upper and lower clamping legs 51, 53 and a connecting portion 52 resiliently interconnecting the upper and lower clamping legs 51, 53. Connecting portion 52 extends vertically through each slot 44 and upper and lower clamping legs 51, 53 extend horizontally from connecting portion 52. Preferably each clamp 50 is made of spring metal, resilient plastic, or any other suitable material so that upper and lower clamping legs are preferably resiliently biased toward each other.

A margin 47 has width 48 which is defined by the distance from the center of slots 44 to the edge of binder insert 20 adjacent the hinge portion 22. A lateral holding width 49 is defined by the distance from the center of slots 44 to the edge of binder insert 20 adjacent opening 26. Preferably the lateral holding width 49 of binder insert 20, or of one or both of the sheets 21, 23, and the thickness of the connecting portion are sufficient to contain a full size 8½×11 piece of paper therein or other standard size paper or object to be contained therein. This arrangement is particularly advantageous because connecting portion 52 prevents sheets and/or other articles secured within binder insert 20 from sliding into the margin 47 and interfering with apertures 30 and rings 15, and the full size sheet of paper is still protected by front and/or back sheet portions 21, 23.

Connecting portion 52 is wider than the thickness of binder insert 20 such that the edges of connecting portion 52 are spaced vertically beyond the outer surfaces of front and back sheet portions 21, 23. Upper and lower clamping legs 51, 53 resiliently extend from connecting portion 52 in a horizontal direction to contact the outer surfaces of front and back sheet portions 21, 23. Upper and lower clamping legs 51, 53 exert a clamping force respectively onto the outer surfaces of front and back sheet portions 21, 23. Furthermore, as can be seen in FIG. 11, when a sheet is inserted within front and back sheet portions 21, 23 connecting portion 52 of C-shaped clamp 50 is expanded and a resultant clamping force is exerted upon the outer surface of front and back sheet portions 21, 23 which acts to clamp the contents within binder insert 20. Alternatively, any number of clamps can be used provided that sufficient force is exerted to retain the contents securely to the binder insert but at least time is preferred in this embodiment to properly locate paper as described above and to reduce twisting.

Upper and lower clamping legs 51, 53 are preferably generally flat so that a significant portion of each leg contacts the outer surface of front and back sheet portions 21, 23 such that the clamping force exerted on front and back sheet portions 21, 23 is spread over a large surface area. This is particularly advantageous because localized friction applied to the contents of the binder insert and pressure thereon is decreased as the force is dispersed over a larger area, thereby reducing the likelihood of tearing or deteriorating or making the sheets and/or other articles contained therein. A preferred clamping force is one which will hold anywhere from 1 to 60 sheets of paper, e.g., range securely within front and back sheet portions 21, 23.

Preferably, upper clamping leg 51 has a tip 54 bent in an upward direction, away from the outer surface of top sheet portion 21 and can be on opposite sides too. Tip 54 is bent to allow for sheets and/or other articles to be easily inserted between the outer surface of top sheet portion 21 and upper clamping leg 51 of C-shaped clamp 50.

Preferably, upper clamping leg 51 is slightly shorter than lower clamping leg 53. Alternatively, the lower clamping leg could be of equal or lesser length than the upper clamping leg. Preferably, C-shaped clamp 50 is made from stainless steel, however, any other material suitable for exerting a clamping force may be used.

Referring to FIGS. 5–9, a second embodiment of the present invention comprises a clipboard binder insert 100, which is also attachable to rings of a conventional ring binder 10. The binder insert 100 according to this embodiment includes a writing tablet 60, a clip 70, and a protective sleeve 80. Tablet 60 is preferably generally a rectangular flat sheet having a clip 70 attached at one edge and binder attachment portion 61 located adjacent a second edge. The tablet is preferably composed of a substantially rigid plastic, such as polypropylene, polyethylene, foamed ethylene or high-impact styrene but can be paperboard wood or other stiff material that is sufficiently rigid to support a page being written on. Preferably tablet 60 is 0.060 to 0.1 inches thick. More preferably, tablet 60 is between 0.075 and 0.080 inches thick. Preferably, at least a front surface number of the tablet is smooth in order to function as a writing surface.

Figure 14:
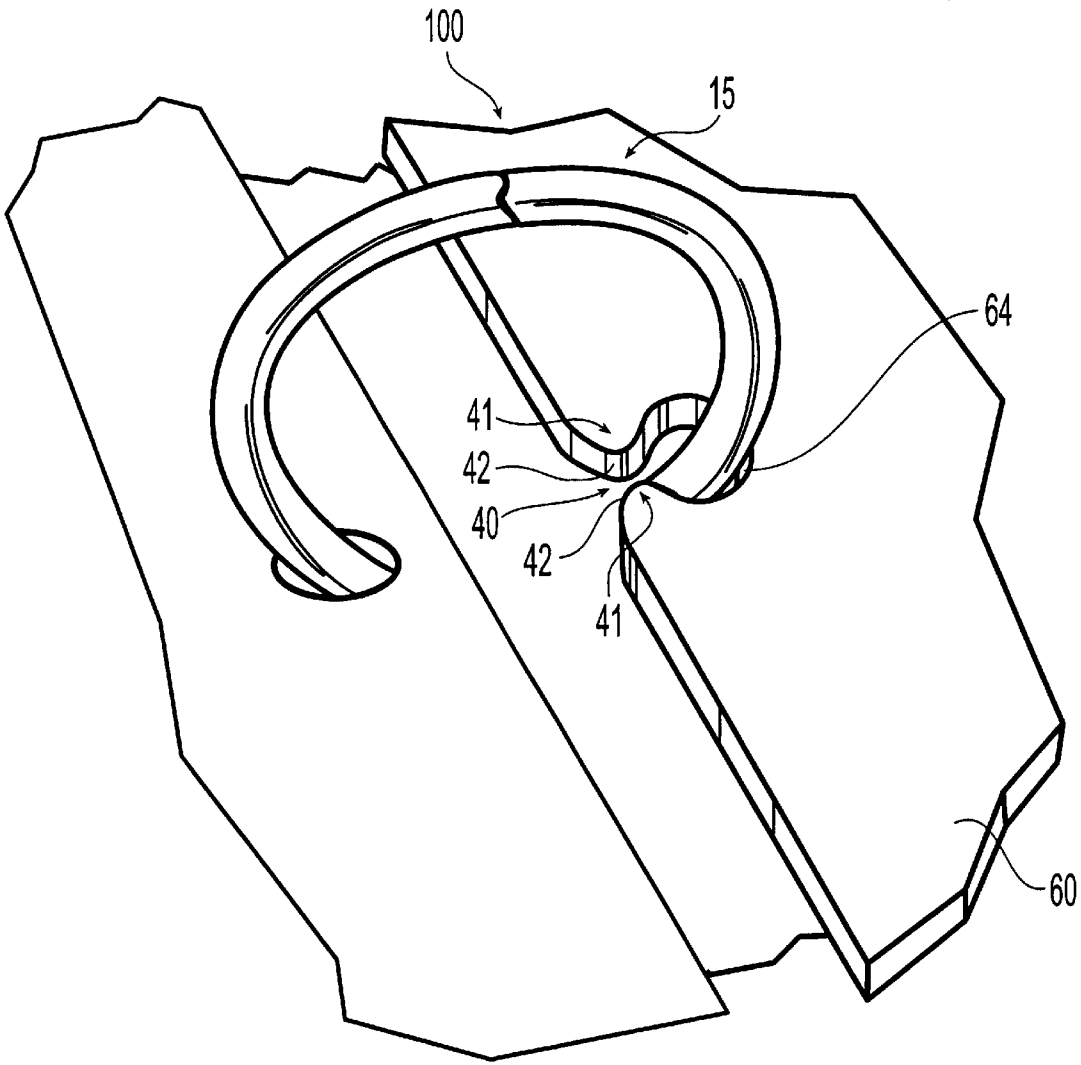
FIG. 14 is an enlarged view of an attachment means of the binder insert of FIG. 5.

The attachment portion 61 is similar to that described above for the first embodiment. Apertures 64 correspond in size, number and position to the rings 15 of ring binder 10, thus allowing binder insert 100 to be placed and held within the binder. Referring to FIG. 14, apertures 64 can include retaining slots 40 which extend from apertures 64 to the outer edge of binder insert 100 and allow binder insert 100 to be snapped in and out of the rings 15 of binder 10. Retaining slots 40 have detents 42 on either side of a throat 41. The slots 40 have a minimum width at their throat 41, which is less than the diameter of apertures 64 and less than the thickness of binder rings 15. It is thus possible to snap binder insert 100 into binder 10 without opening rings 15 by aligning slots 40 with rings 15 and applying pressure until detents 42 are resiliently deformed, allowing rings 15 to pass through the throats 41 of retaining slots 40 into apertures 64. Similarly, binder insert 100 can be removed by pulling it away from ring binder 10, thus causing detents 42 to again deform, after centering rings 15, and allowing rings 15 to pass fully through retaining slots 40. It should be noted that this snap-in and snap-out feature of the invention provides for considerable convenience when using binder insert 100, as it is not necessary to open rings 15 when it is desired to remove binder insert 100 from its position between two pages of the ring binder 10 and/or re-insert it between two other pages. Accordingly, a similar snap-on attachment means can be used with other embodiments as well.

Figure 12:
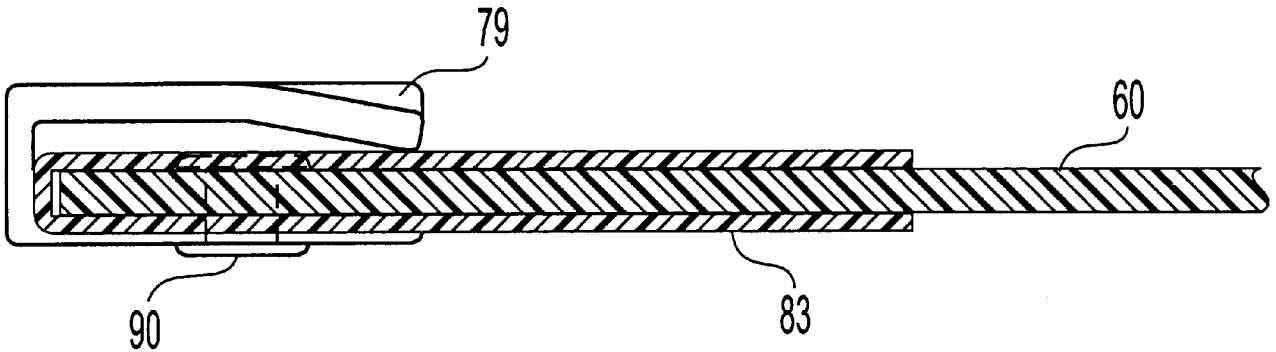
FIG. 12 is a horizontal sectional view of the binder insert of FIG. 5 taken along the line B—B of FIG. 5.
Figure 13:
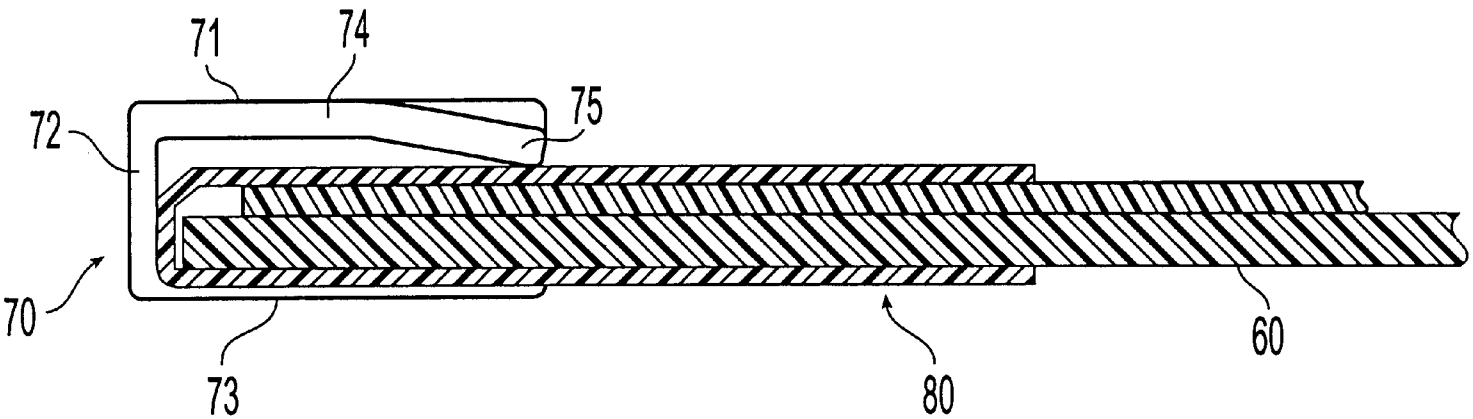
FIG. 13 is a horizontal sectional view of the binder insert of FIG. 5 with a sheet therein taken along the line B—B of FIG. 5.

Referring to FIGS. 12 and 13, clip 70 has a top clip portion 71, a bottom clip portion 73, and a connecting portion 72 interconnecting top and bottom clip portions 71, 73. Clip 70 is generally C-shaped wherein connecting portion 72 is generally straight and top and bottom clip portions 71, 73 extend generally perpendicular to connecting portion 72. Preferably, top and bottom clip portions 71, 73 are wider than they extend longitudinally such that clip 70 is disposed over a significant part of one edge of tablet 60. Top clip portion 71 has two sections 74, 75 which angle downward progressively toward the distal end of top clip portion 71. Preferably, a grip member 76 is associated with at least one of the two sections 74, 75. An inner corner 79 of top clip portion 71 is angled away from tablet 60 to allow clip 70 to slide over protective sleeve 80 more easily. Bottom clip portion 73 is preferably rectangular and preferably extends farther in the horizontal direction than top clip portion 71. Clip 70 is preferably made of polyethylene. Clip 70 has a width 77 and a height 78.

Protective sleeve 80 includes two sheets 81, 83 and a hinge portion 82. Protective sleeve 80 has a top sheet portion 81, a bottom sheet portion 83, and a hinge portion 82 for hinging together adjacent edge sections of the top and bottom sheet portions 81, 83. Preferably protective sleeve 80 is made from one uniform sheet. Top and bottom sheet portions 81, 83 are preferably arcuate. Protective sleeve 80 has a width 85 and height 86. and having overall dimensions of width and length larger than that of clip width 77 and length 78 respectively. Preferably protective sleeve 80 is at least twice as wide and twice as long as clip 70 and preferably less than 50% of the longitudinal length of the tablet 60, and more preferably less than 25%, and most preferably less than ½ as long. Protective sleeve 80 is preferably composed of a polymeric material, however, any other suitable material which has a friction reducing character can be used.

A rivet 90 preferably extends through the bottom protective sheet portion 83, bottom clip portion 73, providing a common pivot location.

Figure 8:
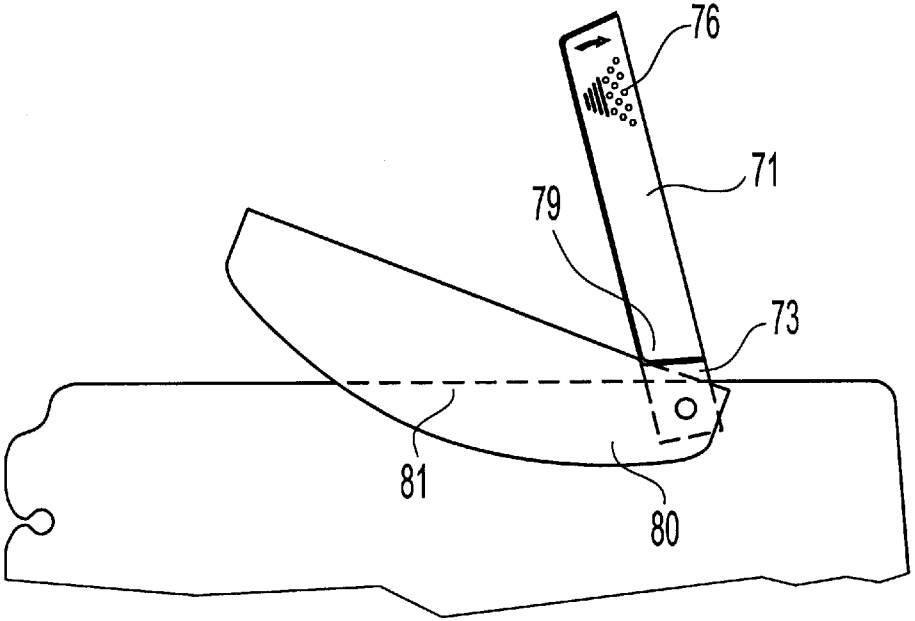
FIG. 8 is an enlarged perspective view of a clip of the binder insert of FIG. 5 in the unclamped position.

Referring now to FIGS. 8, 12, and 13, clip 70 and protective sleeve 80 are preferably pivotally attached to one edge of tablet 60. Both clip 70 and protective sleeve 80 are mounted through a mount hole 62. Mount hole 62 extends through tablet 60, the bottom sheet portion 83 of protective sleeve 80, and the bottom clip portion 73. Both clip 70 and protective sleeve 80 pivot about mount hole 62 and are thus pivotable about an axis that extends through the mount hole 62 and through the tablet 60. Clip 70 is mounted outside protective sleeve 80 so that, in practice, the clip is pivotable from an unclamp position (shown in FIG. 8), where sheets and/or articles can be inserted or removed from tablet 60, to a clamp position (shown in FIGS. 12 and 13) where sheets and/or articles are secured to tablet 60. At the clamp position, top and bottom sheet portions 81, 83 of the protective sleeve 80 straddle tablet 60 and top and bottom clip portions 71, 73 straddle protective sleeve 80 to clamp protective sleeve 80 around the tablet. FIG. 13 shows a sheet clamped between tablet 60 and top sheet portion 81 of the protective sleeve 80. Much like the first embodiment, top and bottom clip portions 71, 73 exert a clamping force respectively onto the outer surfaces of top and bottom sheet portions 81, 83. Furthermore, when a sheet and/or other article is placed between tablet 60 and top sheet portion 81 of protective sleeve 80, connecting portion 72 of clip 70 is expanded and a resulting clamping force is exerted upon the outer surface of top and bottom sheet portions 81, 83 of the protective sleeve 80 which acts to clamp the sheet and/or article between tablet 60 and top sheet portion 81. Because protective sleeve 80 has a larger surface area than the top clip portion 71, less friction is exerted upon a sheet clamped thereto, reducing the likelihood of tearing or deterioration.

While it is apparent that the illustrative embodiments of the invention herein disclosed fulfill the objectives stated above, it will be appreciated that numerous modifications and other embodiments may be devised by those skilled in the art. Therefore, it will be understood that the appended claims are intended to cover all such modifications and embodiments which come within the spirit and scope of the present invention.

What is claimed is:

1. A binder insert comprising:

(a) a folder portion defining at least one ring aperture configured and dimensioned to receive and mount to rings of a binder, the folder portion having:

(i) a first sheet defining a clip-mounting aperture, and (ii) a second sheet facing the first sheet; and (b) a clip having first and second clip portions resiliently biased toward each other, wherein the clip is mounted to the first sheet through the clip-mounting aperture, and the first and second clip portions are disposed in a clamping position on the exterior of the first and second sheets and compressively engaged thereagainst to bias the first and second sheets against each other.

2. The binder insert of claim 1, further comprising a panel disposed between the first and second sheets and the clip portions and defining another clip-mounting aperture, wherein the clip is mounted to the panel through the another clip-mounting aperture.

3. The binder insert of claim 2, wherein the panel comprises a writing tablet with a writing support surface of sufficiently rigid for supporting a page being written on.

4. A paper holder, comprising:

(a) a writing tablet with a writing support surface that is sufficiently rigid for supporting paper being written on;

(b) a protective sheet secured to the writing tablet movably between a clamping and an open position; and (c) a clip secured to the writing tablet movably between a clamping position and an open position;

wherein the clip is resiliently biased against the protective sheet and writing tablet in the clamping position to hold the paper between the protective sheet and the writing tablet.

5. A paper holder, comprising:

(a) writing tablet;

(b) a protective sleeve secured to the writing tablet movably between a clamping and an open position, the protective sleeve including a protective sheet and a back sheet disposed on an opposite side of the writing pad from the protective sheet in the sheet clamping position; and (c) a clip secured to the writing tablet movably between a clamping position and an open position;

wherein in the clamping position the clip is resiliently biased against the protective sheet and writing tablet to hold the paper between the protective sheet and the writing tablet and the clip resiliently biases the back sheet against the writing tablet.

6. The paper holder of claim 4, wherein the tablet has a longitudinal tablet length, and the protective sheet is longitudinally shorter than 50% of the tablet length.

7. The paper holder of claim 6, wherein the protective sheet is longitudinally shorter than 25% of the tablet length.

8. The paper holder of claim 6, wherein the protective sheet is longitudinally shorter than 1/7 of the tablet length.

9. The paper holder of claim 4, wherein the protective sheet is dimensioned to permit writing on the paper held between the writing tablet and the protective sheet in the clamping position.

10. The paper holder of claim 4, wherein the protective sheet is secured to the writing tablet pivotally about an axis that extends through the writing tablet.

11. The paper holder of claim 4, further comprising a pivot securing the clip to the writing tablet pivotally about an axis that extends through the writing tablet.

12. A paper holder, comprising:

(a) a first sheet;

(b) a protective sheet permanently secured to the first sheet movably between a clamping and an open position;

(c) a clip; and (d) a pivot permanently securing the clip to the first sheet pivotally about an axis that extends through the first sheet between a clamping position and an open position;

wherein the clip is resiliently biased against the protective sheet and first sheet in the clamping position to hold the paper between the protective sheet and the first sheet.

13. The paper holder of claim 12, wherein the first sheet comprises a writing tablet with a writing support surface that is sufficiently rigid for supporting paper being written on.

* * * * *